US005664558A

United States Patent [19]

Wagner

[11] Patent Number: 5,664,558

[45] Date of Patent: Sep. 9, 1997

[54] MULTI-TUBULAR DIVING SNORKEL

[76] Inventor: Barry K. Wagner, 10521 Hermanos Ct., San Diego, Calif. 92124

[21] Appl. No.: 608,895

[22] Filed: Feb. 29, 1996

[51] Int. Cl.[6] ..... B63C 11/16

[52] U.S. Cl. ..... 128/201.11; 128/201.27; 128/201.28

[58] Field of Search ..... 128/201.11, 201.27, 128/201.28

[56] References Cited

U.S. PATENT DOCUMENTS

| | | | |
|---|---|---|---|
| 2,362,775 | 11/1944 | Sebouh | 128/201.11 |
| 4,230,106 | 10/1980 | Geeslin et al. | 128/201.11 |

FOREIGN PATENT DOCUMENTS

| | | | |
|---|---|---|---|
| 2675112 | 10/1992 | France | 128/201.11 |
| 189504 | 4/1957 | Germany | 128/201.11 |
| 488713 | 1/1954 | Italy | 128/201.11 |
| 729878 | 12/1966 | Italy | 128/201.11 |
| 312092 | 6/1969 | Sweden | 128/201.11 |
| 9117916 | 11/1991 | WIPO | 128/201.11 |

*Primary Examiner*—Aaron J. Lewis

[57] ABSTRACT

A multi-tubed diving snorkel, comprising first and second elongated air tubes positioned side-by-side between an upper end and a lower end of the snorkel. A first valve device is positioned at the upper end of the snorkel for permitting air to flow only in a first direction through a first one of the two tubes and only in a second opposite direction through the second of the two tubes. A second valve device is positioned at the lower end of a snorkel adjacent a mouthpiece for permitting air to flow only in the first direction through the first tube and only in the second direction through the second tube. The side-by-side configuration of the tubes is more flexible than concentric tubes and the use of a valve device adjacent the mouthpiece reduces unwanted mixing of exhaust and intake gases.

21 Claims, 4 Drawing Sheets

MULTI-TUBULAR DIVING SNORKEL

BACKGROUND OF THE INVENTION

1. Field of the Invention

The present invention relates generally to the field of snorkels used for diving and more specifically to a multi-tubular diving snorkel having generally parallel elongated tubes to substantially prevent the mixture of intake air and exhaust air to avoid a respiratory efficiency reduction that would otherwise occur when intake air and exhaust air are mixed in a conventional snorkel tube.

2. Prior Art

The prior art closest to the present invention of which the applicants are aware is disclosed in U.S. Pat. No. 5,117,817 to Lin and is entitled, Vertical Co-axial Multi-tubular Diving Snorkel. This patent is directed to a multi-tubular diving snorkel in which coaxial outer and inner tubes provide substantially separated exhale and inhale channels. Like the present invention, this device attempts to use valves in order to assure that intake air enters only one of the two channels and exhaust air enters only the other of the two channels. There are however, at least two significant disadvantages of this prior art device. The most significant is the fact that the inner tube is terminated well before the mouthpiece of the snorkel, adjacent the bottom end thereof, resulting in a significant mixture of intake and exhaust air at the lower end of the snorkel, despite the separated tube structure thereof. Consequently, despite the attempts to provide separate channels where intake air flows through only one such channel and exhaust air flows through only the other such channel, because the inner coaxial channel does not extend the full length of the snorkel, there is a significant reduction in the efficiency of separating the dirty air from the clean air, thus partially defeating the advantage of having two separate channels.

Another significant disadvantage of the aforementioned prior art arises from an inherent difficulty in the geometry of such a snorkel in which separate tubes are coaxial or concentric. More specifically, because of the inherent nature of coaxial tubes, the outer tube must have a significantly larger diameter than the inner tube and because the inner tube must have a sufficiently large diameter to provide an unimpeded exhale channel, the outer tube must have a larger diameter than that normally desired in a snorkel tube.

It would thus be highly advantageous to provide a multi-tubular diving snorkel which has the advantages of the aforementioned prior art, namely significant separation between dirty and clean air, the former being exhaled air and the latter being intake air but, while at the same time, overcoming the aforementioned disadvantages of such prior art. More specifically, it would be desirable to have a multi-tubular diving snorkel in which the separation of intake and exhaust air is more significant and efficient and in which the relative cross-section of the separated tubes are independent of one another and thus may be controlled without concern of how one affects the other as is inherent in the aforementioned prior art.

SUMMARY OF THE INVENTION

The present invention satisfies the aforementioned need for a multi-tubular diving snorkel which overcomes the aforementioned disadvantages of the prior art by providing a side-by-side tubular configuration having valves both at the top of the snorkel and at the bottom of the snorkel to more thoroughly segregate intake air and exhaust air.

Furthermore, in the present invention, the relative size and shape of the individual channels for exhaust and intake air, respectively, may be readily modified without concern for respective sizes or the interference of one tube with the other. In the preferred embodiment disclosed herein, the two tubes are substantially rectangular in cross-section and are separated from one another by a substantially planar uniform wall along their entire lengths. In a preferred embodiment, the tubes terminate at their upper ends in a substantially horizontal direction along a relatively common planar surface which is enclosed by a split butterfly valve that is spring loaded and is normally in a closed position, sealing off the top ends of both tubes. The upper valve is designed to rotate about an axis which is supported by the central wall segregating the two tubes. That portion of the butterfly valve which seals the exhaust tube will only open in an outward direction and that portion of the butterfly valve which seals the intake tube will only open inwardly.

The lower end of the multi-tube snorkel of the present invention is also provided with at least one valve. Three different embodiments of respective valve structures are illustrated herein. In one configuration, a pair of mushroom valves placed in oppositely facing directions on the respective tubes, permits exhaust air from the mouthpiece to pass into only one such tube and intake air to enter the mouthpiece from only the other such tube. In a second embodiment, a balanced butterfly valve is provided and similarly segregates intake and exhaust air at the mouthpiece. Finally, in a third embodiment a piggyback valve is provided which accomplishes the aforementioned segregation of intake and exhaust air with respect to the mouthpiece and the pair of side-by-side configured tubes of the snorkel.

OBJECTS OF THE INVENTION

It is therefore a principal object of the present invention to provide a multi-tube diving snorkel in which exhaust air from the diver's lungs and intake air from the atmosphere are channeled through separate side-by-side configured tubes and in which the segregation of exhaust air and intake air is made more efficient by the use of valve structures at both top and bottom ends of the snorkel tubes.

It is an additional object of the present invention to provide a multi-tube diving snorkel in which exhaust air and intake air are segregated into separate tubes which are configured to be side-by-side so that the shape and dimensions of one such tube do not necessarily dictate the shape and dimensions of the other such tube.

It is still an additional object of the present invention to provide a multi-tubular diving snorkel wherein valve structures at both the top and bottom ends of separate tubes used for exhaust and intake air, respectively, reduce the inadvertent mixture of such intake and exhaust gases as compared to the closest known prior art.

BRIEF DESCRIPTION OF THE DRAWINGS

The aforementioned objects and advantages of the present invention, as well as additional objects and advantages thereof, will be more fully understood hereinafter as a result of a detailed description of preferred embodiments when taken in conjunction with the following drawings in which.

DETAILED DESCRIPTION OF PREFERRED EMBODIMENTS

Figure 1:
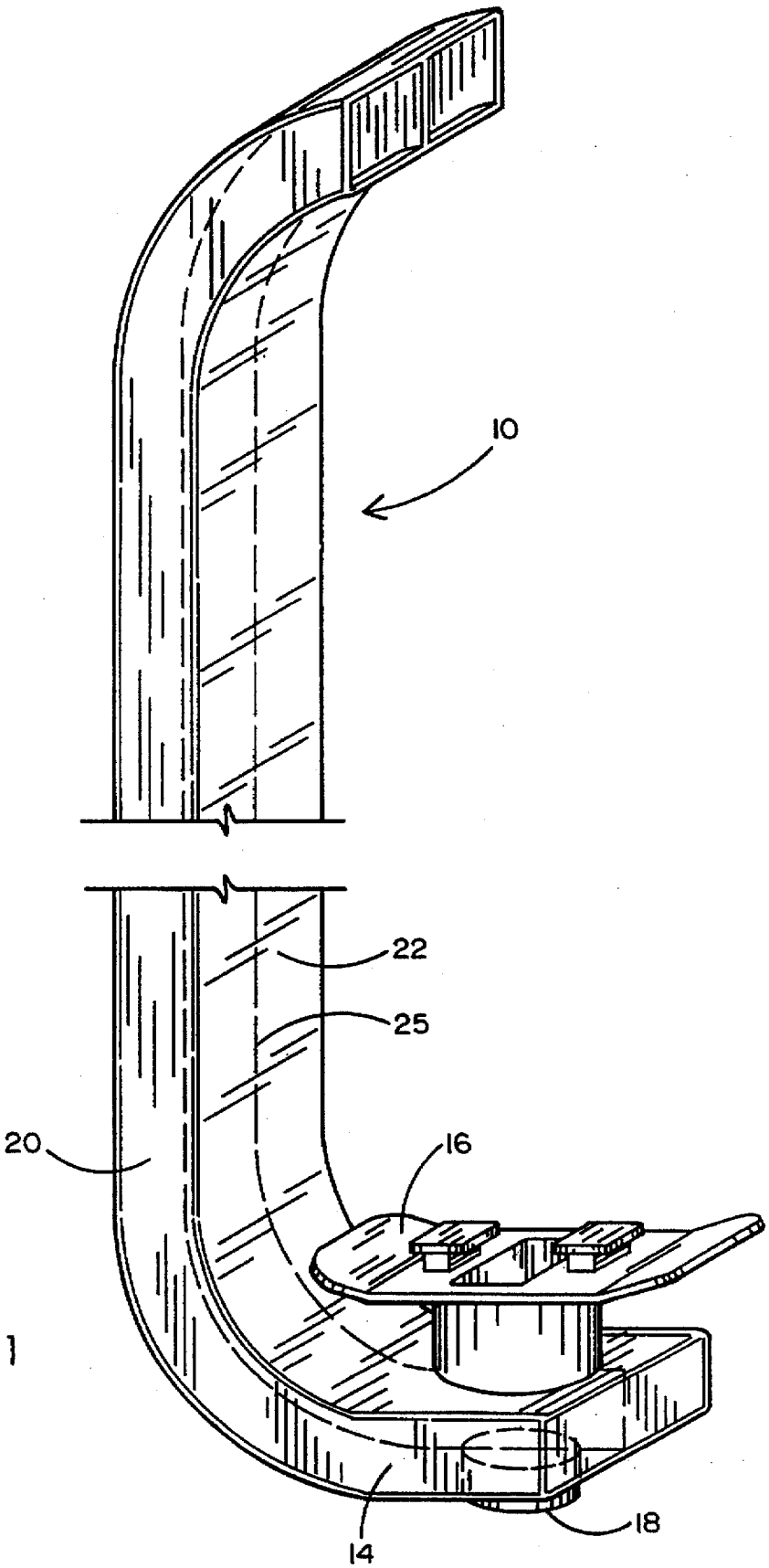
FIG. 1 is a three dimensional view of a diving snorkel made in accordance with the present invention.

Referring now to FIG. 1, it will be seen that a multi-tube snorkel 10, having an upper end 12 and a lower end 14, comprises a mouthpiece 16, purge valve 18 and a pair of side-by-side oriented elongated tubes, namely first tube 20 which provides passage for exhaust gases from the mouthpiece and second tube 22 which provides for passage of intake air to the mouthpiece. It will also be seen in FIG. 1, in the particular configuration of the preferred embodiment illustrated therein, the two tubes 20 and 22 are joined at an interface wall 25. It will be understood that the precise shape of the respective tubes 20 and 22 may be selected from a large number of alternatives. By way of example, the tubes may have a cross-sectional shape that is rectangular or elliptical or oval or circular or of a shape that is more complex, such as flat along the interface wall 25 and otherwise curved in some selected fashion. Such shapes may improve stability of the snorkel and also streamline effects for reducing flow resistance for swimming. Furthermore, it will be understood that the precise shape of the respective tubes need not be identical. By way of example, one tube may be flattened more than the other: one tube may have a rectangular shape, while the other has an oval shape: one tube may be of a different cross-sectional area than the other. For example, the intake passage may be broader in cross-sectional area than the exhaust passage. Significantly, the most important aspect of the separate exhaust and intake tubes of the present invention is that the mixture of gases between the two tubes is held to a minimum, preferably being virtually zero. This is accomplished by the use of valves and in the preferred embodiment shown herein, the valves are positioned at both the upper and lower ends of the first and second tubes 20 and 22, respectively.

Figure 2:
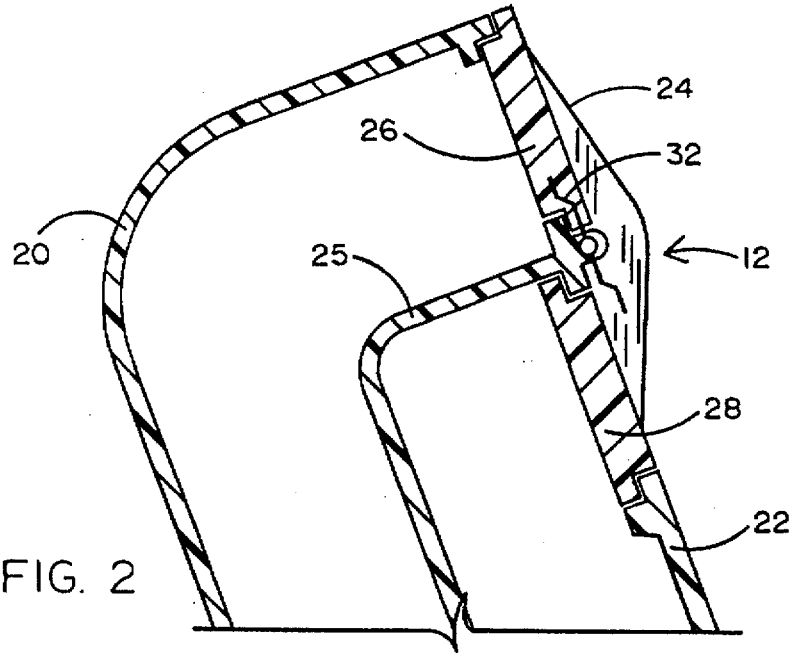
FIG. 2 is an enlarged view of the upper end of the snorkel tubes of the present invention, illustrating an exemplary valve structure used therein.

Referring now to FIG. 2, it will be seen that an upper end valve 24 of the present invention comprises an exhaust flap 26 and an intake flap 28, forming a split butterfly valve, having a common fulcrum 30 through which there is positioned a spring 32, tending to keep the flaps 26 and 28 closed onto the exhaust tube 20 and intake tube 22, respectively. Valve 24 opens these tubes only when the diver is taking in clean air or exhausting dirty air, in which case the pressure differential induced by the diver's lungs (either over-pressure while exhausting the gas or under-pressure while inhaling the gas) is sufficient to overcome the tension of the spring 32 and open the valve 24. Such valves may be equal in size or preferrably different in size to increase sealing pressure below the surface.

Figure 3:
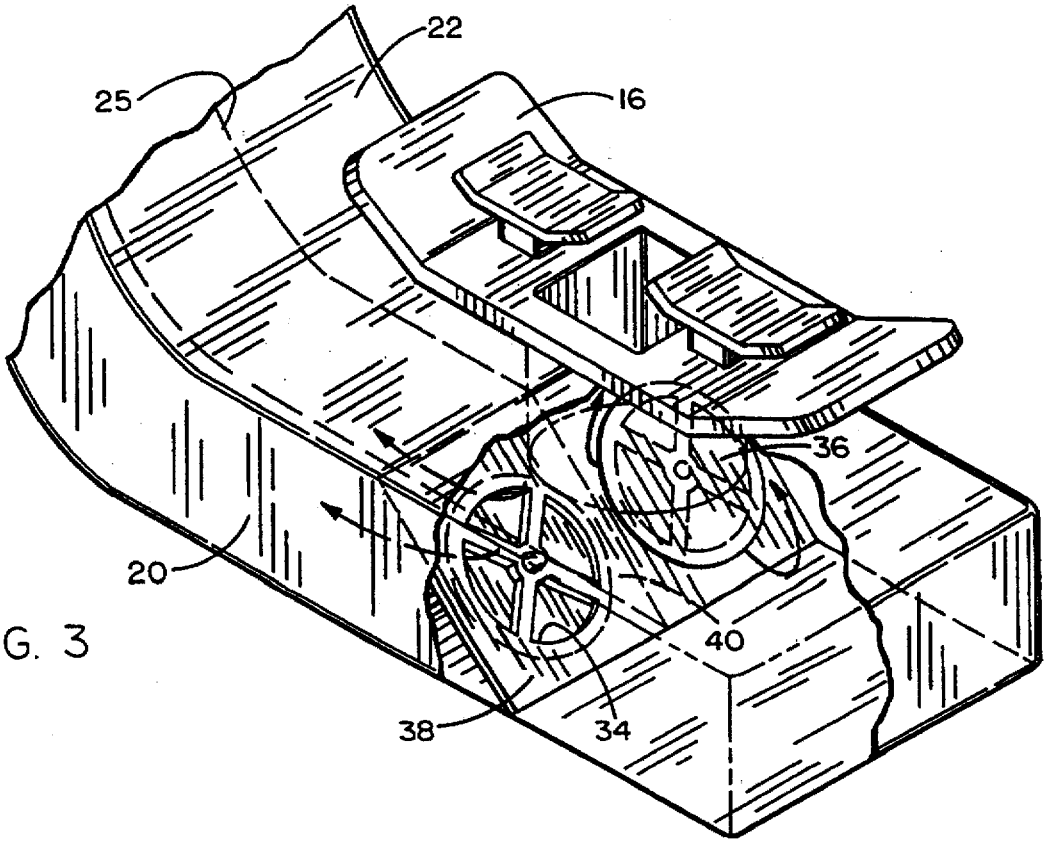
FIG. 3 is a three dimensional illustration of a first embodiment of a valve structure used at the lower end of the snorkel tubes of the invention, adjacent the mouthpiece to segregate intake and exhaust air.
Figure 4:
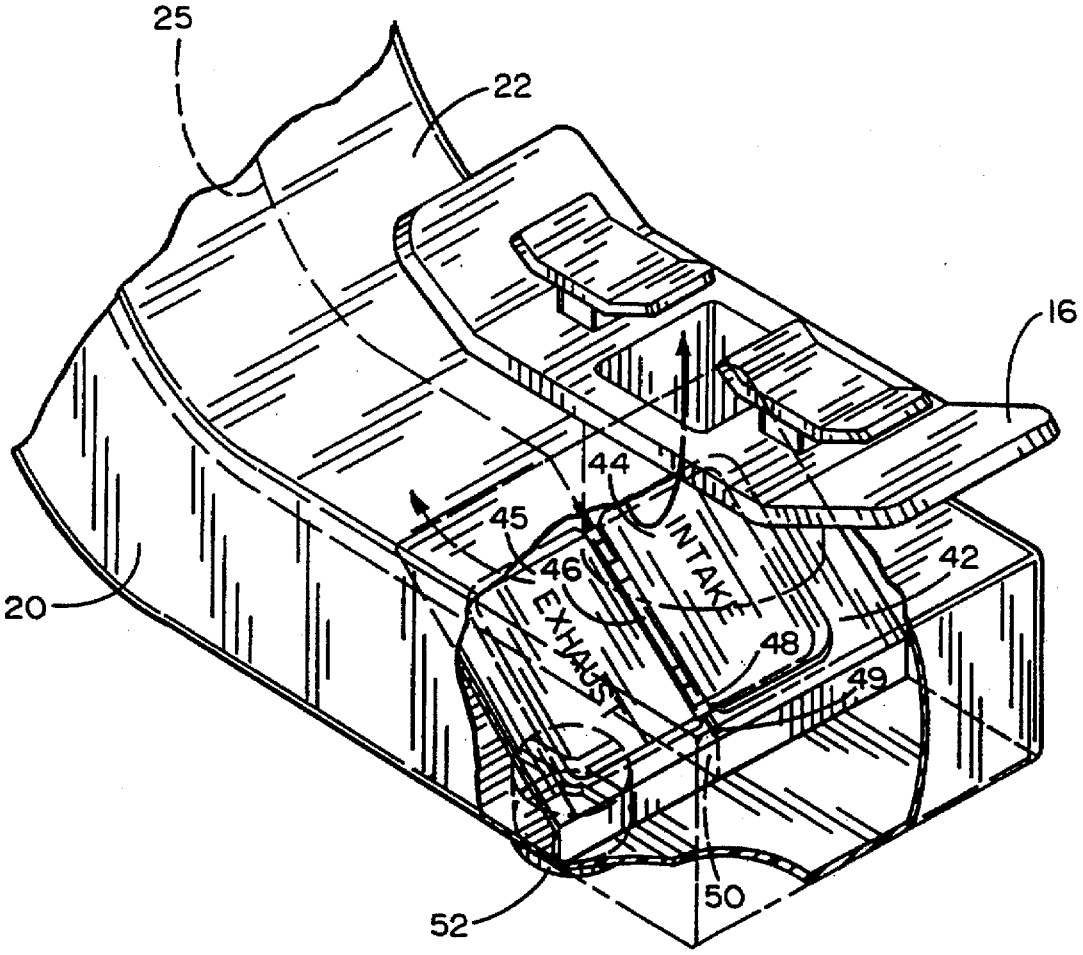
FIG. 4 is an illustration similar to that of FIG. 3, but showing a second embodiment of a valve structure that may be used at the lower end of the snorkel tubes for segregating intake and exhaust gases.
Figure 5:
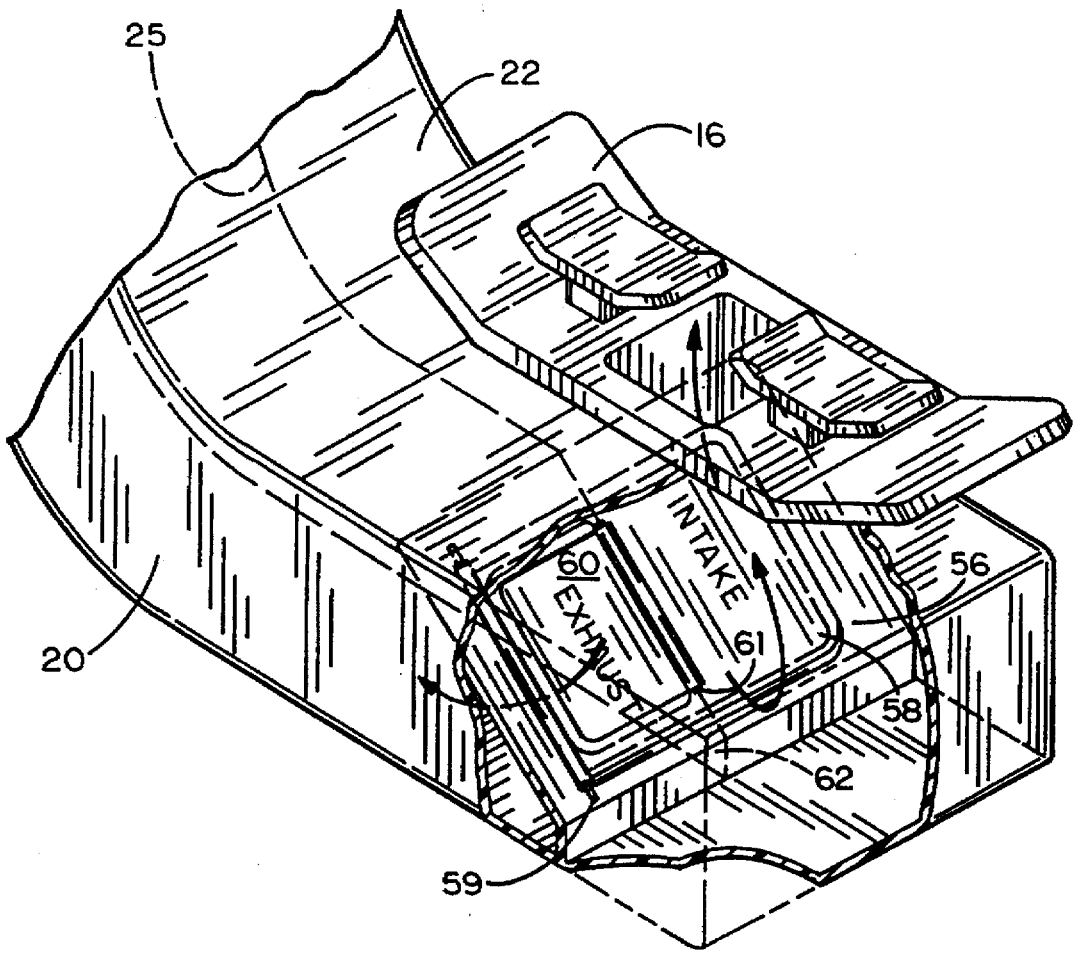
FIG. 5 is a three dimensional view similar to that of FIG. 3 and 4, but illustrating still an additional third embodiment of a valve structure used at the lower end of the snorkel tubes, adjacent the mouthpiece to segregate the intake and exhaust gases.

The present invention also provides one or more valve devices at the lower end of the snorkel in order to minimize mixture of exhaust and intake gases, even in that interior region of the snorkel adjacent the mouthpiece. Three alternative valve configurations for the lower end of the snorkel are illustrated in FIGS. 3, 4 and 5, respectively. In the configuration shown in FIG. 3, a pair of oppositely directed mushroom valves are implemented as an exhaust valve 34 and an intake valve 36, positioned on a plenum 38, immediately below the mouthpiece 16 and supported by a septum 40. Septum 40 further divides the lower end of the snorkel into a pair of substantially isolated chambers, one for exhaust air and one for intake air.

In FIG. 4, a second embodiment of a lower valve device is shown, wherein a combined valve 42 comprises an intake flap 44 and an exhaust flap 45, both adapted to rotate about a fulcrum axis 46, supported by a pin 49 which rotates against a spring 48. Spring 48 keeps both intake and exhaust flaps closed unless there is a change in diver lung pressure, tending to either expel exhaust gases or create a suction for taking in air. A septum 50 separates the lower portion of the snorkel into substantially isolated chambers to prevent any significant mixing of exhaust and intake gases. A purge valve 52 of a generally conventional nature is also provided at the lower end of the snorkel.

Still a third embodiment of the invention in regard to the lower valve device is illustrated in FIG. 5. This embodiment also utilizes a combined valve 56, but this particular combined valve employs an intake flap 58 and an exhaust flap 60, the latter being part of the former. The respective flaps rotate about different axes, namely, intake flap axis 59 and exhaust flap axis 61, respectively. This combined valve 56 is also referred to herein as a "piggyback" valve because the exhaust flap 60 rides "piggyback" on the intake flap 58. A septum 62 is also provided, forming two generally isolated air chambers within the lower end of the snorkel in the same manner as the other two embodiments of FIGS. 3 and 4.

It will now be understood that what has been disclosed herein comprises a multi-tubed diving snorkel, comprising first and second elongated air tubes positioned side-by-side between an upper end and a lower end of the snorkel. A first valve device is positioned at the upper end of the snorkel for permitting air to flow only in a first direction through one of the two tubes and only in a second opposite direction through the other of the two tubes. A second valve device is positioned at the lower end of a snorkel adjacent a mouthpiece for permitting air to flow only in said first directions through the first tube and only in a second direction through the second tube. A number of exemplary valve devices have been disclosed herein for purposes of explaining the invention and providing exemplary illustrations thereof in accordance with the best mode known to the applicant. However, it will be understood that a variety of different valve device mechanisms not shown herein may also be used and that their relative positions may be altered, such as for example, by connecting them directly to the mouthpiece at the lower end of the snorkel to further minimize the opportunity for exchanging bad and good air.

Those having skill in the art to which the present invention pertains, will now as a result of the applicant's teaching herein, perceive various modifications and additions which may be made to the invention. By way of example and in addition to the various alternative valve device mechanisms that may be used herein, it will also be understood that the precise shape and dimensions of the respective elongated side-by-side snorkel tubes used herein, may be readily changed as well. Accordingly, all such modifications and additions which may be made to the invention are contemplated as being within the scope thereof which is to be limited only by the claims appended hereto and their equivalents.

I claim:

1. A multi-tube diving snorkel comprising:

first and second elongated air tubes positioned side-by-side between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower; and a second valve device positioned at the lower end of said snorkel adjacent said mouthpiece for permitting air to flow only in said first direction through said first tube and only in said second direction through said second tube;

wherein said first valve device comprises a split butterfly valve having a first flap covering said first tube at said upper end and having a second flap covering said second tube at said upper end.

2. The diving snorkel recited in claim 1 wherein said split butterfly valve comprises a spring for closing said first and second flaps whenever there is no gas flow in either of said first and second tubes.

3. A multi-tube diving snorkel comprising:

first and second elongated air tubes positioned side-by-side between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said second valve device comprises a pair of valves separated by a septum, said valves being oriented for gas flow only from said mouthpiece to exhaust air through one said tube and only to said mouthpiece to take in air through the other said tube.

4. The diving snorkel recited in claim 3 wherein said pair of valves comprises a pair of mushroom valves and said septum is positioned between said mushroom valves within said lower end of said snorkel.

5. A multi-tube diving snorkel comprising:

first and second elongated air tubes positioned side-by-side between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said second valve device comprises a pivot valve;

wherein said pivot valve comprises an exhaust flap and an intake flap, said flaps being configured to rotate together about a hinge pivot axis against a spring force.

6. The diving snorkel recited in claim 5 wherein said exhaust flap is greater in surface area than said intake flap.

7. The diving snorkel recited in claim 5 further comprising a septum dividing said lower end of said snorkel into an exhaust region and an intake region.

8. A multi-tube diving snorkel comprising:

first and second elongated air tubes positioned side-by-side between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said second valve device comprises a piggyback valve said piggyback valve having first and second valve flaps which seat in a common plane and which rotate in opposite directions during operation.

9. The diving snorkel recited in claim 8 wherein said piggyback valve comprises an intake flap and an exhaust flap, said exhaust flap forming a portion of said intake flap, said flaps being configured to rotate about separate pivot axes.

10. The diving snorkel recited in claim 9 further comprising a septum dividing said lower end of said snorkel into an exhaust region and an intake region.

11. A multi-tube diving snorkel comprising:

first and second elongated air tubes positioned side-by-side between an upper end of said snorkel and a lower end of said snorkel;

a valve device positioned at the upper end of said snorkel for permitting air to flow only in a first direction through said first tube and only in a second direction, opposite said first direction, through said second tube;

a mouthpiece positioned adjacent said lower end;

wherein said valve device comprises a split butterfly valve having a first flap covering said first tube at said upper end and having a second flap covering said second tube at said upper end.

12. The diving snorkel recited in claim 11 wherein said split butterfly valve comprises a spring for closing said first and second flaps whenever there is no gas flow in either of said first and second tubes.

13. A multi-tube diving snorkel comprising:

first and second elongated air tubes positioned betweenan upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said first valve device comprises a split butterfly valve having a first flap covering said first tube at said upper end and having a second flap covering said second tube at said upper end.

14. The diving snorkel recited in claim 13 wherein said split butterfly valve comprises a spring for closing said first and second flaps whenever there is no gas flow in either of said first and second tubes.

15. A multi-tube diving snorkel comprising:

first and second elongated air tubes positioned between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said second valve device comprises a pair of valves separated by a septum, said valves being oriented for gas flow only from said mouthpiece to exhaust air through one said tube and only to said mouthpiece to take air in through the other said tube.

16. The diving snorkel recited in claim 15 wherein said pair of valves comprises a pair of mushroom valves and said septum is positioned between said mushroom valves within said lower end of said snorkel.

17. A multi-tube diving snorkel comprising:

first and second elongated air tubes positioned between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said second valve device comprises a pivot valve;

wherein said pivot valve comprises an exhaust flap and an intake flap, said flaps being configured to rotate together about a hinge pivot axis against a spring force.

18. The diving snorkel recited in claim 17 further comprising a septum dividing said lower end of said snorkel into an exhaust region and an intake region.

19. A multi-tube diving snorkel comprising:

first and second elongated air tubes positioned between an upper end of said snorkel and a lower end of said snorkel;

a first valve device positioned at the upper end of said snorkel for permitting air to flow only in a first direction through said first tube and only in a second direction, opposite said first direction, through said second tube;

a mouthpiece positioned adjacent said lower end;

a second valve device positioned at the lower end of said snorkel adjacent said mouthpiece for permitting air to flow only in said first direction through said first tube and only in said second direction through said second tube;

wherein said second valve device comprises a piggyback valve said piggyback valve having first and second valve flaps which seat in a common plane and which rotate in opposite directions during operation.

20. The diving snorkel recited in claim 19 wherein said piggyback valve comprises an intake flap and an exhaust flap, said exhaust flap forming a portion of said intake flap, said flaps being configured to rotate about separate pivot axes.

21. The diving snorkel recited in claim 20 further comprising a septum dividing said lower end of said snorkel into an exhaust region and an intake region.

* * * * *